US005236023A

United States Patent [19]

Mohr

[11] Patent Number: 5,236,023

[45] Date of Patent: Aug. 17, 1993

[54] RETAINING ASSEMBLY FOR FLUID DISPENSING NOZZLES

[76] Inventor: Robert B. Mohr, P.O. Box 1171, Galesburg, Ill. 61402

[21] Appl. No.: 796,536

[22] Filed: Nov. 21, 1991

[51] Int. Cl.[5] ..... B65B 1/04

[52] U.S. Cl. ..... 141/312; 141/368; 141/363; 141/385

[58] Field of Search ..... 141/311 R, 312, 332, 141/340, 346, 363, 366-368, 382-386; 285/320, 420; 29/261, 262; 269/48.1; 606/198

[56] References Cited

U.S. PATENT DOCUMENTS

| | | | |
|---|---|---|---|
| 998,352 | 7/1911 | Kublin | 141/340 |
| 1,164,704 | 12/1915 | Gourembis | 29/262 |
| 1,657,013 | 1/1928 | Kettle | 141/312 |
| 2,528,369 | 10/1950 | Jensen | 285/320 |
| 4,187,913 | 2/1980 | Wilcox | 285/320 |
| 4,354,536 | 10/1982 | Moss | 141/383 |

FOREIGN PATENT DOCUMENTS

| | | | |
|---|---|---|---|
| 0577184 | 5/1946 | United Kingdom | 285/320 |

*Primary Examiner*—Henry J. Recla
*Assistant Examiner*—Robert A. Goldman
*Attorney, Agent, or Firm*—Glenn H. Antrim

[57] ABSTRACT

A collar attached around a nozzle has a pivot from which an arm extends. In a contracted position, the arm extends close along the nozzle toward the discharge end thereof to facilitate insertion of the nozzle into an opening of a tank. While in the opening, the arm is turned far enough, by an extension outside the opening, through an acute angle to contact the inside edge of the opening and therefore to force the nozzle in an opposite direction against the inside edge. A latch connected to the arm maintains, until the latch is released, the arm in an expanded or wedging position for retaining the nozzle in the opening. Another embodiment uses three arms evenly spaced for wedging the nozzle in a centered position in an opening.

6 Claims, 2 Drawing Sheets

RETAINING ASSEMBLY FOR FLUID DISPENSING NOZZLES

BACKGROUND OF THE INVENTION

This invention relates to fluid dispensing nozzles and particularly to retaining assemblies attached to respective nozzles for retaining nozzles in openings, such as in openings of diesel tanks while tractors of semitrailers are being refueled.

Conventionally, attendants at service stations perform various services while tanks of tractors are being refueled after valves of nozzles have been latched open. Unfortunately, the nozzles can be dislodged readily from openings of diesel tanks, and since the open nozzles dispense large amount quickly, much fuel is lost and must be cleaned from driveways of service stations. The significant difference between the sizes of the openings of the tanks and the size of the usual nozzles contributes to the tendency for the nozzles to be dislodged during filling. Presently, the openings may be as small as 2¼ inches (50.4 mm) and as large as 5 inches (127 mm).

SUMMARY OF THE INVENTION

A retaining assembly of this invention positions a retaining portion of an arm along a nozzle to which the assembly is attached. The arm is pivoted near the handle of the nozzle and at a short radial distance from the outer surface of the nozzle. During insertion of the nozzle in the opening of a tank to be filled, the retaining portion is in a contracted position closely along the nozzle from the pivot of the arm toward the outlet of the nozzle. The arm has an operating portion extending outside the opening from the pivot for turning the retaining portion outwardly in an axial plane of the nozzle through a desired acute angle to an expanded position. In the expanded position, the outer edge of the retaining portion at a point spaced from the pivot contacts an inner edge of the opening in which the nozzle has been inserted, and the outer surface of the nozzle contacts a diametrically opposite point of the opening to wedge the nozzle in the opening.

The operating portion of a preferred embodiment functions as a handle, and a holding arm is pivoted to the handle. The holding arm may have a single tooth for engaging a catch to hold the retaining portion of the pivoted arm in one expanded position or may be like a rack having a plurality of angled teeth for respective expanded positions.

A somewhat more complicated retaining assembly has a plurality of retaining arms on pivots spaced about a nozzle. When the retaining portions of the arms are in expanded positions, the nozzle is held in a centered position within the opening. The operating portions of the arms are relatively short and extend from the respective pivots about in line with the respective retaining portions. Rounded ends of the operating portions contact a concave surface of a collar, and as an adjacent collar that supports pivots of the arms is turned on a threaded shank to change the distance between the collars, the retaining portions are either expanded or contracted according to the direction of turning.

DESCRIPTION OF THE PREFERRED EMBODIMENTS

Figure 1:
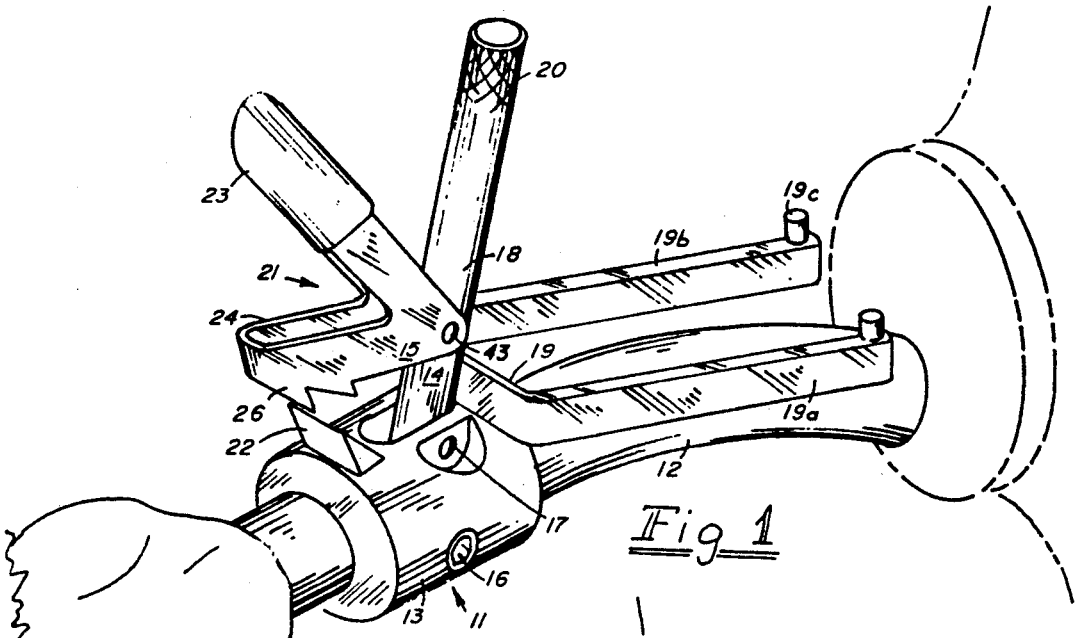
FIG. 1 is an oblique, perspective view of a preferred retaining assembly of this invention, a single retaining arm, or equivalent closely spaced arms, is shown in a contracted position to be inserted in an opening along with a nozzle.
Figure 2:
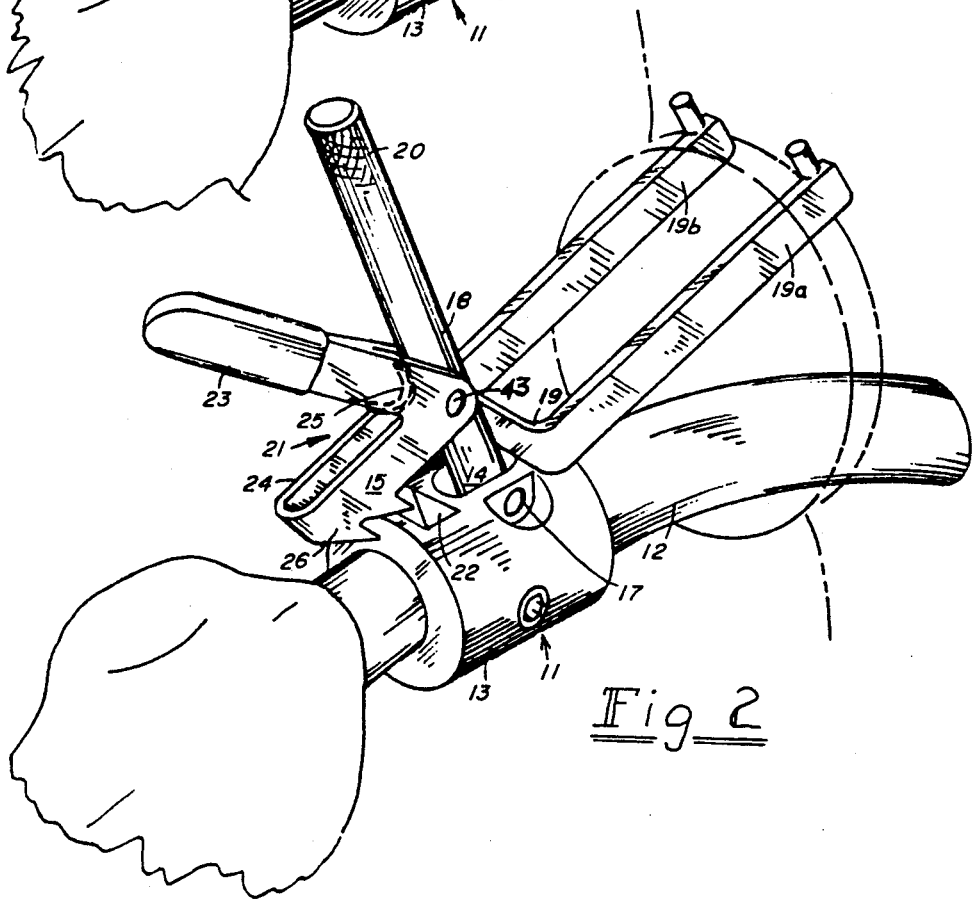
FIG. 2 shows a similar view of the preferred retaining assembly with the retaining arm in an expanded position within an opening of a tank.

A preferred retaining assembly 11 to be used at service stations on nozzles for filling tanks with diesel is shown in FIGS. 1 and 2. The assemblies are inexpensive, reliable, and convenient to use. In FIG. 1, the retaining assembly 11 is shown in a released position to facilitate insertion of the nozzle 12 to which it is connected into an opening or entrance pipe of a tank, and in FIG. 2 the assembly is shown operated to retain the nozzle within the opening.

The retaining assembly 11 includes a collar 13 fitting tightly around the nozzle at a point spaced from the outlet of the nozzle and usually quite close to a valve of the nozzle. An arm 14 is pivoted to the collar 13. A catch assembly 15 includes a holding arm 24 pivoted to the arm 14 for retaining the arm 14 in an expanded position as shown in FIG. 2.

The collar 13 slips over the nozzle and is secured by a set screw 16. A pivot 17 for the arm 14 is located a short radial distance from the outer surface of the nozzle 12. A flat portion of an end of the arm 14 is a sliding fit between sides of a rectangular recess within the outer surface of the collar 13 approximate the end facing the outlet of the nozzle 12, and the pivot 17 across the recess permits the arm 14 to be turned in a plane that extends through the axis of the collar 13.

For control of the turning of the arm 14, an operating portion 18 of the arm 14 extends outwardly from the pivot 17, and for wedging nozzles within openings, a retaining portion 19 extends from the pivot 17 along the nozzle toward the outlet. The arm 14 according to the construction shown in FIGS. 1 and 2 is easily fabricated and has necessary strength. The retaining portion 19 is U-shaped with extended parallel retaining portions **19*a* and 19*b*. The center of the short transverse portion connecting the portions 19*a* and 19*b* is attached to the arm 14 a short distance from the pivot 17 and the portions 19*a* and 19*b*** extend along the nozzle toward the outlet.

The operating portion 18 is a bar, one end is flat for connection to the pivot 17, and the other end is a control handle 20 with a knurled surface. The portion 18 can be turned forward by the handle 20 toward the outlet of the nozzle to, or a little beyond, the position perpendicular to the axis of the collar 13 and may be turned back through an acute angle. In the forward position, the retaining portion 19 is in a contracted position, and in the back position, the retaining portion is in the expanded position.

The catch assembly 15 latches the operating portion 18 with the attached parallel portions **19*a* and 19*b* in the outwardly slanting expanded position. The assembly includes an angular retaining member 21 pivoted to the operating portion 18, and a catch 22 to be engaged by the retaining member. The retaining member has a handle 23 and a holding arm 24 as sides of an acute angle, and a pivot 43 near the apex of the sides connects the retaining member 21 to the operating portion 18 at a point a short distance from the pivot 17. The catch 22, shaped like an angular tooth with a back side slanted away from the pivot 17 in an upward direction, protrudes from the outer surface of the collar 13 from a point spaced back of the pivot 17**.

The side or edge of the holding arm 24 facing the catch 22 has at least one tooth 26 with a surface slanted to contact the slanted surface of the catch 22. Preferably, the arm 24 has a few teeth to latch the parallel portions 19*a* and 19*b* in different expanded positions after being turned through different acute angles from the contracted position. A flat spring 25 is curved to fit between the operating arm 18 and the handle 23 for urging the teeth 26 of the holding arm 24 in contact with the catch 22.

If the catch assembly 15 is not already in a released position as required before filling a tank, an operator places his hand about both the handles 20 and 23 for disengaging the holding arm 24 from the catch 22. After the nozzle is inserted into an opening, the operator pulls back on the handle 20 to expand the parallel retaining portions 19*a* and 19*b* for contacting the inner edge of the opening in an area diametrically across from an area contacted by the nozzle 12.

Usually, the retaining portions are in contact at points spaced from the distal ends of the retaining portions 19*a* and 19*b* such that the retaining portions and the nozzle 12 form a wedge having a wider end within the opening. To retain the nozzle 12 in the largest openings for a tooth 26, a pin 19*c* extending perpendicularly outwardly from the distal end of each of the retaining portions 19*a* and 19*b* may contact the inside surface of a tank about its opening. By having a plurality of teeth 26 on the holding arm 24, the nozzle 12 can be retained in openings have diameters varying over a large range. After inserting the nozzle, the operator pulls the handle 20 with moderate force to expand the retaining portion 19 and then a tooth 26 that provides the most suitable degree of expansion engages the catch 22. The handle 23 of the catch assembly 15 is squeezed toward the handle 20 for releasing the holding arm 24 from the catch 22 to permit withdrawal of the nozzle 12.

Figure 3:
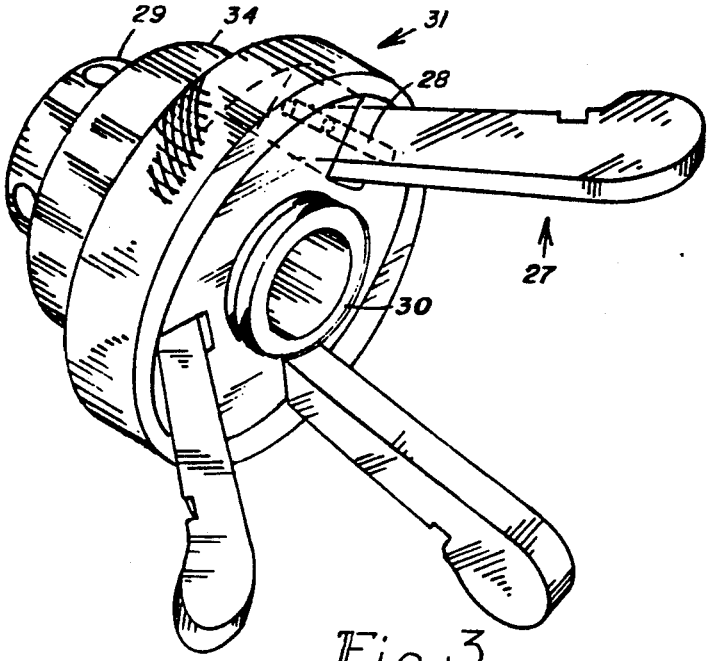
FIG. 3 is an oblique, perspective view of another embodiment showing a plurality of pivoted arms positioned about a nozzle and directed toward the outlet thereof.
Figure 4:
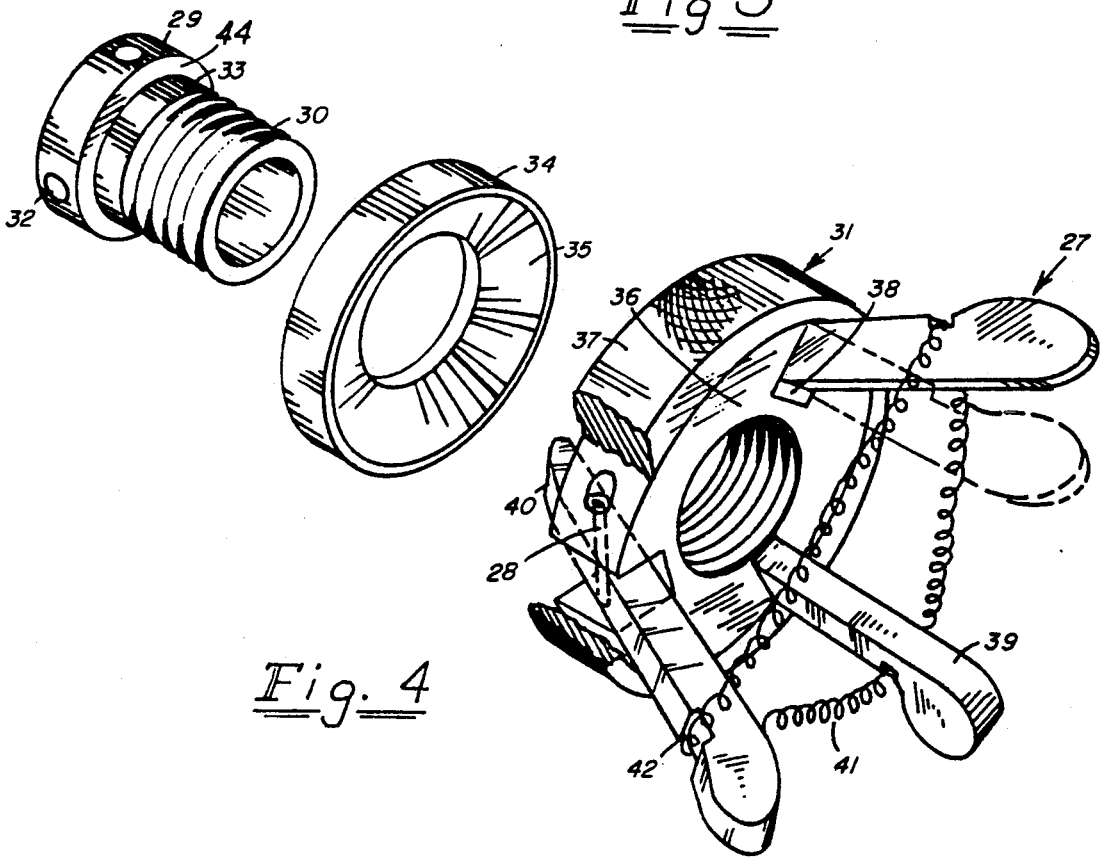
FIG. 4 is an exploded view of the retaining assembly of FIG. 3.

The retaining assembly of FIGS. 3 and 4 has three main components: a first collar 29 with an externally threaded shank 30, a second or intermediate collar 34 with a concave surface 35, and a third collar 31 with a plurality of pivots 28 for three spaced peripheral arms 27. A shank 30 extends axially from the collar 29, has an axial bore through which a nozzle is to be inserted, and has sufficient length to receive the collars 34 and 31 and to permit required adjustment of the collar 31. The three arms 27 are preferably equally spaced for substantially centering in an opening a nozzle to which the assembly is attached.

The diameter of the central opening through the intermediate collar 34 is slightly greater than the maximum diameter of the external threads on the shank 30, and the central hole through the collar 31 has internal threads to be mated with the external threads. After the arms 27 have been assembled to the collar 31, the three main components are assembled by merely slipping the collar 34, with the concave surface outward, over the shank 30 and then turning the collar 31, with retaining portions 39 outward, onto the shank. The plane inner face of the collar 34 and the relatively narrow inside surface between the plane inner face and the concave surface 35, bear respectively against a shoulder 43 around the inner end of the shank 30 and a smooth bearing surface 33 between the shoulder 43 and the threads of the shank.

To facilitate pivotally connecting the arms 27, the collar 31 has an inner ring 36 with the axial threaded hole and an outer ring 37 fitting tightly about the inner ring. The arms 27 are a sliding fit within respective equally spaced rectangular cutouts, each having a pair of sides parallel to a respective radius of the ring 36, an inward side cut in from the periphery far enough to permit rotation of a respective arm 27 in a radial direction, and an outer side that is open before assembly of the outer ring 37. The pivots 28 are across approximate centers of the radial sides, each being fitted in a hole drilled from the circumference of the ring parallel to end surfaces of the ring 36 and perpendicular to the radius thereof. After the arms are positioned and the pivots are set, the outer ring 37 is fitted tightly in a usual manner such as by heating before being pressed together.

Similar to the single arm of FIGS. 1 and 2, each of the three arms 27 has the retaining portion 39 and an operating portion 40. However, each operating portion 40 extends from the respective pivot 28 nearly in line with the retaining portion 39 to be directed into the concave surface 35 of the ring 34. The distal ends of the operating portions 40 are rounded for easy spiral movement like a cam inward over the concave surface 35. The length of the operating portions 40 are such that the inner ends touch the outer rim of the concave surface 35 while the collar 31 is in a usual outermost position a few turns from the outer end of the shank 30. Turning the collar 31 for inward movement moves the inner ends of the operating portions over the inward slanting surface 35 to turn the retaining portions evenly outwardly.

The retaining portions 39 have sufficient length such that slanting outer surfaces contact the inner edge of an opening to wedge the nozzle, to which the assembly of FIGS. 3 and 4 is attached, in a centered position after the collar 31 is turned tightly inward. The outer surface of the outer ring 37 is preferably knurled to facilitate adjustment. Each operating portion 39 may have an intermediate notch 42 in its outer surface for receiving a resilient band 41, such as a loop of coiled spring wire, to urge the three arms 27 toward respective contracted positions.

I claim:

1. A retaining assembly for a fluid dispensing nozzle to retain said nozzle within openings of different sizes, said nozzle having a cylindrical outer surface and a discharge end, means for attaching said retaining assembly around said nozzle such that said nozzle extends through said retaining assembly, a pivot within said retaining assembly located at a comparatively short distance radially outward from said outer surface of said nozzle, said retaining assembly being attached at a sufficient distance from said discharge end of said nozzle to position said discharge end inside any of said opening and to position said pivot outside any of said openings into which said nozzle is to be inserted, an arm pivotally attached to said pivot, said arm having a retaining portion, control means connected to said retaining portion and directed therefrom to be outside any of said openings during normal use of said nozzle, said retaining portion being pivoted on said pivot and being positioned to extend therefrom along said nozzle toward said discharge end thereof, said control means being operative to turn said retaining portion on said pivot through an angle between a contracted position close along said cylindrical outer surface of said nozzle and an expanded position away from said cylindrical outer surface and then to retain said retaining portion in said expanded position, said retaining portion having sufficient length to wedge said retaining portion and said nozzle within any of said openings while said retaining portion is in said expanded position, and said control means being operative subsequently to return said retaining portion to said contracted position.

2. A retaining assembly as claimed in claim 1 wherein said pivoted arm has an operating portion extending rigidly at an angle from said retaining portion and wherein said control means comprises: said operating portion, the junction of said portions being approximate said pivot, a catch assembly for retaining said retaining portion in said expanded position, said catch assembly comprising a holding arm with an angular tooth and a releasing handle extending at an angle from said holding arm, said holding arm being pivoted to said operating portion, a catch fixed on the assembly and positioned to be engaged by said angular tooth, a spring bearing between said operating portion and said releasing handle to urge engagement of said tooth with said catch, and said releasing handle being operative for releasing said holding arm to return said retaining portion to said contracted position.

3. A retaining assembly as claimed in claim 2 wherein said holding arm has a plurality of angled teeth, said control means being operative to turn said retaining portion through a different acute angle to a respective expanded position corresponding to a respective tooth of said teeth, and said respective tooth of said angled teeth engaging said catch to retain said retaining portion in said respective expanded position.

4. A retaining assembly as claimed in claim 1 wherein said retaining assembly has a plurality of said pivots like said pivot and a plurality of pivoted arms similar to said pivoted arm on respective ones of said pivots, said respective pivots being spaced circumferentially about said nozzle, each of said pivoted arms having an operating portion extending from said respective retaining portion, said portions of each respective pivoted arms extending in opposite directions from said respective pivots, a first collar having said means for attaching said retaining assembly and having an externally threaded, hollow shank extending coaxially toward said discharge end, a second collar positioned freely about said shank, the surface of said second collar facing said discharge end being a concave surface, a third collar containing said pivots connected to said pivoted arms, said third collar having an inside threaded bore for receiving said shank and being turned onto said shank to position said retaining portions toward said discharge end and to position respective distal ends of said operating portions in contact with said concave surface, and wherein manual rotation of said third collar in one direction turning said retaining portions simultaneously to respective ones of said contracted positions and in an opposite direction to respective ones of said expanded positions.

5. An adapter to fit over a tubular fluid dispensing nozzle for retaining said nozzle within an opening, said adapter comprising a tubular collar, means for fastening said collar around said nozzle, said collar having a pivot at a position spaced from an inside surface of said collar, an outwardly extending triangular catch on said collar, said catch and said pivot being spaced axially apart on said collar, an operating handle with an end connected to said pivot, a retaining arm extending from a point on said handle approximate said pivot in a direction away from said handle and substantially parallel to a longitudinal axis through said collar, said operating handle to be turned about said pivot through an acute angle for turning said retaining arm between a contracted position in which said arm is substantially parallel to the longitudinal axis of said collar to an expanded position in which said retaining arm is directed outwardly from said axis at a selected acute angle to said axis, a holding arm having an angular tooth for engaging said catch, a releasing handle extending from said holding arm, said holding arm and said releasing handle being pivoted to said operating handle at a point spaced from said pivot of said operating handle, means connected between said handles to urge said holding arm to turn in a direction for engaging said angular tooth with said catch, said operating handle being operative to turn said retaining arm from said contracted position to said expanded position, said retaining arm being retained in said expanded position by said tooth engaging said catch, and said releasing handle being operative to disengage said tooth from said catch.

6. An adapter as claimed in claim 5 wherein said holding arm has a portion having a plurality of teeth including said tooth, said teeth corresponding to respective different expanded positions of said retaining arm, and said operating handle being operative through different acute angles for turning said retaining arm to said different expanded positions to be retained by respective ones of said teeth.

* * * * *